US005150494A

United States Patent [19]

Wenzer

[11] Patent Number: 5,150,494

[45] Date of Patent: Sep. 29, 1992

[54] PAINT BRUSH WITH DOME SHAPED MEMBER FOR PREVENTING PAINT FROM COLLECTING IN THE FERRULE

[76] Inventor: Kenneth C. Wenzer, 14011 Chestnut La., Laurel, Md. 20707

[21] Appl. No.: 684,265

[22] Filed: Apr. 12, 1991

[51] Int. Cl.[5] ..... A46B 3/02

[52] U.S. Cl. ..... 15/159.1; 15/193

[58] Field of Search ..... 15/159 R, 186, 187, 15/192, 193, 204, 246

[56] References Cited

U.S. PATENT DOCUMENTS

| | | | |
|---|---|---|---|
| 916,383 | 3/1909 | Alexander | 15/193 |
| 1,160,370 | 11/1915 | Bradshaw | 15/159 R |
| 2,258,361 | 10/1941 | Hewes | 15/192 |
| 3,386,119 | 6/1968 | Shulman | 15/193 |

FOREIGN PATENT DOCUMENTS

| | | | |
|---|---|---|---|
| 227099 | 6/1958 | Australia | 15/193 |
| 3025010 | 1/1982 | Fed. Rep. of Germany | 15/192 |
| 388677 | 3/1933 | United Kingdom | 15/192 |

*Primary Examiner*—Harvey C. Hornsby
*Assistant Examiner*—Mark Spisich
*Attorney, Agent, or Firm*—Robert Halper

[57] ABSTRACT

A paint brush configured to facilitate cleaning, prevent stiffening of the bristles and extend the life of the brush having a dome shaped member positioned between the lower end of the bristles and ferrule.

3 Claims, 1 Drawing Sheet

PAINT BRUSH WITH DOME SHAPED MEMBER FOR PREVENTING PAINT FROM COLLECTING IN THE FERRULE

BACKGROUND OF THE INVENTION

This invention is concerned with paint brushes. Conventionally a paint brush is made up by having a plurality of bristles extending outwardly and mounted in a ferrule containing a binder or plastic composition for maintaining the bristles and attached to a handle. The problem with most brushes is that it is difficult to clean the bristles after painting. This becomes increasingly more so after each painting, since the paint tends to dwell in the ends of the bristles where the bristles join the binder. After a number of paintings the paint forms a hardened mass. The result is that the bristles are no longer flexible and a good paint job becomes difficult.

Mechanical cleaning of the brushes has been achieved by use of pressurized fluid introduced at the base of the bristles. A most recent U.S. Pat. No. 4,916,773, has apparently produced very good results by having internal cleaning means incorporated in the brush. In this patent the bristles are incorporated into a block where the block has a plurality of apertures supporting the bristles, and the apertures act as conduits communicating with the bristles to which cleaning fluid is introduced. While the efficiency of this apparatus is not to be denied, the invention in the paint brush of this application is of a much simpler as well as different design.

SUMMARY OF THE INVENTION

It has been found that after painting, the paint that settles and gathers near the bristles at the point where the bristles join the binder is not uniformly distributed, that is, the paint has a tendency to build up more or less in the shape of a dome. Now this shape results even after the brush is subjected to conventional cleaning procedures such as with a cleansing agent and interposition of a wire brush between the bristles. In fact it has been found that cleaning with a wire brush accentuates the dome shape. Accordingly, it was determined that cleaning the brush could be facilitated by applying a dome shaped member between the lower ends of the bristles and the ferrule. This dome shaped member is not a perfect hemisphere and is fashioned to reproduce as closely as possible what has been observed to occur as a natural phenomenon. As can be seen with reference to the drawings, rather than a consistent regular increase in the slope there is only a very slight inclination of the dome at the juncture with the ferrule, followed by a more rapid ascent to the peak which would be somewhat less than the peak of a true dome. Accordingly, instead of the conventional method of directly fastening the bristles to a binder within a ferrule, a dome-like shaped member is first fastened to the binder in the ferrule with the bristles extending uniformly through the dome-like shaped member and then being imbedded in the binder. Alternatively and preferably in place of binder and adhesively bound dome shaped member, a unitary plastic member dome-like shaped at the top and descending into a lower rectangular section that is fitted into the ferrule can be designed. The handle is further secured within the ferrule and spaced a distance from the binder in a conventional manner. The dome shaped member will now be the repository of paint that remains on the brush on the completion of the job and any paint present therein can easily be removed by scraping with a wire brush or any other scraping element. The dome-like shaped plastic member facilitates cleaning per se, since the interposition of a rectangular block of plastic between the lower ends of the bristles and the ferrule has little effect in so far as cleaning of the brush with a scraping implement. While the use of dome shaped members for brushes is not new as shown by U.S. Pat. Nos. 1,160,370 and 2,240,547, these dome shaped members have no relationship to the functioning or design of the dome shaped member in the present invention.

Therefore, it is a primary object of the present invention to make available a novel paint brush having a flat rectangular end portion *2a* and a narrow portion *2b* medial of said rectangular portion and extending vertically thereof a dome-like shaped member that joins the bristles at the point of junction with the ferrule so as to facilitate cleaning of the brush and preventing paint from lodging in the lower end of the bristles.

It is a further of the invention to provide a novel paint brush simple in design and so configured as to enable efficient cleaning with a minimal amount of cleaning fluid.

BRIEF DESCRIPTION OF THE DRAWINGS

For a further understanding of the invention reference is made to the following description taken in conjunction with the enumerated drawings wherein.

DESCRIPTION OF THE PREFERRED EMBODIMENT

Figure 2:
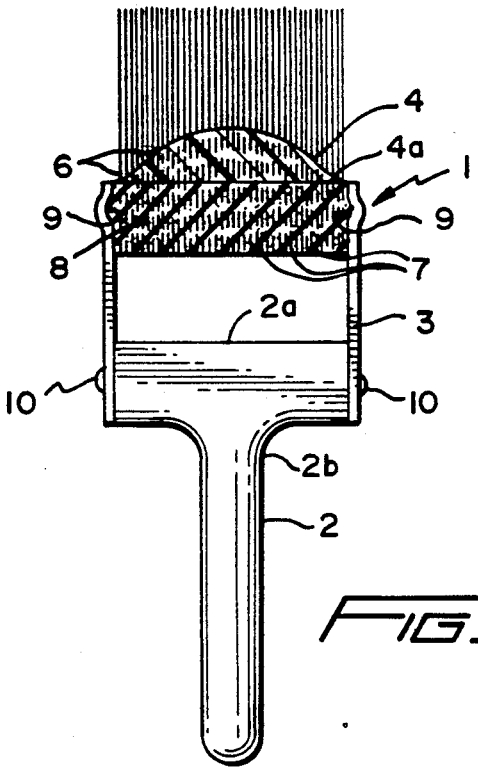
FIG. 2—is a sectional view taken along line 2—2 of FIG. 1 showing details of the construction.
Figure 1:
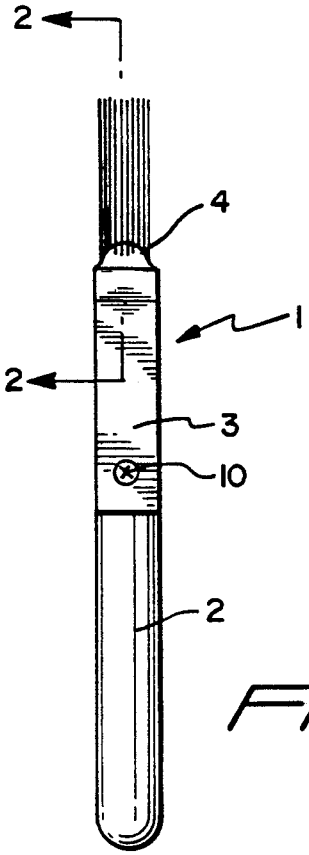
FIG. 1—is an end view of the paint brush showing the dome-like shaped member.
Figure 3:
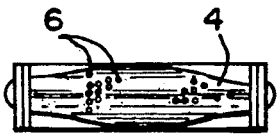
FIG. 3—is a plan view taken along line 3—3 of FIG. 1 showing the dome-like shaped member with perforated holes for insertion of the bristles.
Figure 4:
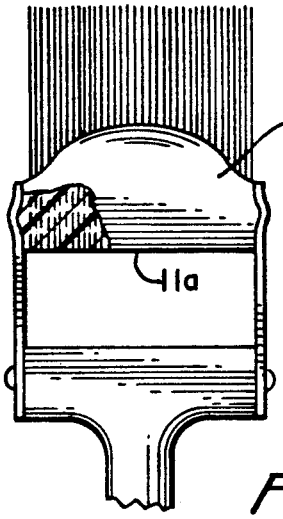
FIG. 4—is a modification of the sectional view of FIG. 2 showing a unitary plastic member.
Figure 5:
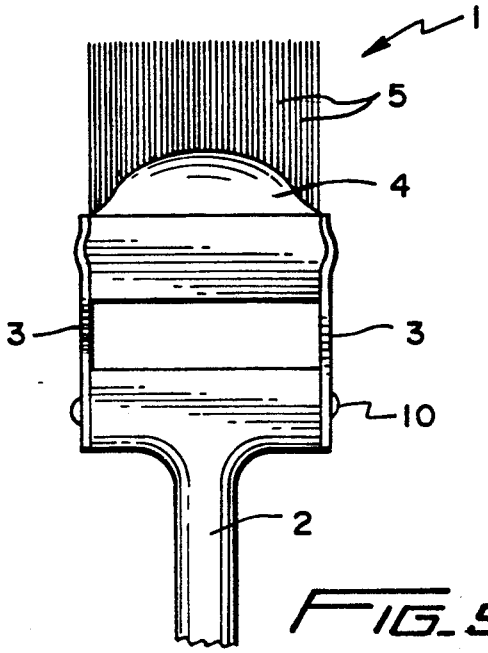
FIG. 5—is a front view showing the dome-like shaped member.

With reference to FIG. 1, there is shown a paint brush 1 that includes a wooden handle 2 having a flat rectangular end portion *2a* and a narrow portion *2b* medial of said rectangular portion and extending vertically thereof, a metal ferrule 3, a plastic dome shaped member 4 of substantial depth and having a flat lower end *4a* as seen in FIGS. 2 and 5 and bristles 5. As seen in FIG. 3, there appear two curves symmetrically located about an imaginary horizontal axis, located medially thereof and enclosed in a rectangle. In the cross sectional view of FIG. 2 the bristles are shown extending through perforations 6 in the dome shaped member with their butt ends 7 embedded in a binder 8 which may be a plastic composition such as an epoxy resin. The dome shaped plastic member may be any machineable hard plastic such as polyethylene, an ABS (acrylonitrile butadiene styrene) resin, a polycarbonate, etc. The dome shaped member is adhesively bonded to the binder after the butt ends of the bristles are embedded therein. The metal ferrule extends from the juncture of the dome with the binder to the rectangular lower end portion of the handle. The ferrule has grooves 9 for securing the binder. The lower end portion of the handle is spaced from the binder and is secured within the lower portion of the ferrule by rivets 10. The embodiment of FIG. 4 shows a unitary plastic member 11 dome shaped at the top, an intermediate portion, descending into a lowermost rectangular portion 11*a* that is inserted into the ferrule. Perforations extend throughout the dimension of the plastic member for the insertion of the bristles. The butt ends of the bristles are adhesively bonded to the plastic member at the end of the rectangular section and the rectangular section is secured in the ferrule by the aforementioned grooves. As can be seen, there is only one novel feature of the invention and that is the dome shaped plastic member. As stated above, the tendency of paint to settle in the lower end of the bristles with consequent buildup of a heavy sediment which prevents flexibility of the bristles is overcome by simply placing a dome shaped member between the lower end of the bristles and their butt ends. Therefore, any paint that settles will accumulate on the plastic member which can then be readily scraped off.

While this invention has been designed primarly with paint brushes in mind, it is obvious that its application could be extended to any type of brush wherein a liquid media is to be applied and such liquid has a tendency to harden.

What I claim is:

1. A paint brush configured so as to facilitate cleaning the brush bristles comprising a handle having a flat rectangular end portion, an annular metal ferrule secured to said handle a binder evenly dispersed in said ferrule and secured by grooves formed in said ferrule, (and) said binder being spaced from said end portion of said handle, a dome-like shaped hard plastic member having a flat lower end adhesively bonded to said binder and having a plurality of perforations extending through said dome shaped member, a plurality of bristles extending through said perforations and having butt ends, said butt ends being immersed and fixed in the binder, said dome-like shaped member having a first portion which protrudes away from the handle and second portions on opposite sides of the first portion which taper to the ferrule to form a generally convex barrier between the exposed bristles and the binder, whereby paint collected during painting settles on the dome-like shaped member rather than in the binder to facilitate mechanical removal of the paint.

2. A paint brush as in claim 1 wherein said plastic dome shaped member is a machineable plastic selected from one of several plastics such as polyethylene, ABS resin, polycarbonate and said binder is an epoxy resin.

3. A paint brush configured so as to facilitate cleaning the brush bristles and preserving the life of the brush comprising a handle having a flat rectangular end portion and a narrow portion medial of said rectangular portion and extending vertically thereto an annular metal ferrule secured to said handle, a hard, machineable plastic member having a dome-like shaped top portion, an intermediate portion that descends into a lowermost rectangular portion, said lower portion being secured in grooves formed in said ferrule and spaced from said end portion of said handle, said plastic member having perforations extending throughout its length and bristles having butt ends, said butt ends passing through said perforations and being adhesively bonded to the rectangular portion at its lowermost end, said dome shaped member having a first portion which protrudes away from the handle and second portions on opposite sides of the first portion which taper to the ferrule to form a generally convex barrier between the exposed bristles and the ferrule, whereby paint collected during painting settles on the dome-like shaped member rather than in the ferrule to facilitate mechanical removal of the paint.

* * * * *